US008428827B2

(12) United States Patent
McKee et al.

(10) Patent No.: US 8,428,827 B2
(45) Date of Patent: Apr. 23, 2013

(54) APPARATUS AND METHOD FOR CONTROLLING ROTATIONAL MOVEMENT OF A VEHICLE TURRET

(75) Inventors: Michael A. McKee, Aurora, IL (US); John E. Hayden, Aurora, IL (US)

(73) Assignee: Control Solutions LLC, Aurora, IL (US)

( * ) Notice: Subject to any disclaimer, the term of this patent is extended or adjusted under 35 U.S.C. 154(b) by 91 days.

(21) Appl. No.: 13/188,038

(22) Filed: Jul. 21, 2011

(65) Prior Publication Data

US 2012/0191304 A1 Jul. 26, 2012

Related U.S. Application Data

(60) Provisional application No. 61/435,073, filed on Jan. 21, 2011.

(51) Int. Cl.
*G05D 3/00* (2006.01)

(52) U.S. Cl.
USPC ..... 701/48; 701/49; 700/9; 700/85

(58) Field of Classification Search ..... 701/48, 701/49; 700/9, 11, 66, 83, 85
See application file for complete search history.

(56) References Cited

U.S. PATENT DOCUMENTS

| | | | | |
|---|---|---|---|---|
| 5,625,159 | A | 4/1997 | Malolepsy et al. | |
| 5,880,395 | A | 3/1999 | Krumm et al. | |
| 6,101,917 | A | 8/2000 | Klatte et al. | |
| 6,701,821 | B2 | 3/2004 | Lundqvist et al. | |
| 6,922,615 | B2 * | 7/2005 | Pillar et al. | 701/1 |
| 7,006,902 | B2 * | 2/2006 | Archer et al. | 701/1 |
| 7,021,189 | B2 | 4/2006 | Patry et al. | |
| 7,107,129 | B2 * | 9/2006 | Rowe et al. | 701/1 |
| 7,127,331 | B2 * | 10/2006 | Pillar et al. | 701/1 |
| 7,162,332 | B2 * | 1/2007 | Pillar et al. | 701/1 |
| 7,184,862 | B2 * | 2/2007 | Pillar et al. | 701/1 |
| 7,274,976 | B2 * | 9/2007 | Rowe et al. | 701/1 |
| 7,451,028 | B2 * | 11/2008 | Pillar et al. | 701/50 |
| 7,555,369 | B2 * | 6/2009 | Pillar et al. | 701/1 |
| 8,095,247 | B2 * | 1/2012 | Pillar et al. | 701/1 |
| 2003/0163229 | A1 * | 8/2003 | Pillar et al. | 701/1 |
| 2007/0230451 | A1 * | 10/2007 | Porat et al. | 370/357 |
| 2008/0215190 | A1 * | 9/2008 | Pillar et al. | 701/1 |
| 2010/0332087 | A1 * | 12/2010 | Claffee et al. | 701/49 |
| 2012/0144991 | A1 * | 6/2012 | Hayden et al. | 89/41.02 |
| 2012/0191292 | A1 * | 7/2012 | McKee et al. | 701/33.1 |

* cited by examiner

*Primary Examiner* — Russell Frejd

(74) *Attorney, Agent, or Firm* — McCracken & Frank LLC

(57) ABSTRACT

An apparatus for controlling rotational movement of a turret of a vehicle is provided. The apparatus includes a first communication port that is adapted to receive input signals from a first input device for controlling rotation of the turret. A second communication port is adapted to receive input signals from a second input device for controlling rotation of the turret. A controller generates control signals for operational control of the vehicle turret in response to receipt of an input signal from at least one of the first and second input devices.

32 Claims, 6 Drawing Sheets

APPARATUS AND METHOD FOR CONTROLLING ROTATIONAL MOVEMENT OF A VEHICLE TURRET

CROSS-REFERENCE TO RELATED APPLICATION

The present application claims the priority benefit of U.S. Provisional Patent Application Ser. No. 61/435,073 filed Jan. 21, 2011 and entitled "Apparatus and Method for Controlling Rotational Movement of a Vehicle Turret," the disclosure of which is incorporated herein by reference.

FIELD OF THE INVENTION

This invention relates to apparatuses for controlling rotational movement of vehicle turrets and, in particular, relates to apparatuses for controlling rotational movement of vehicle turrets in response to input signals generated by input devices.

BACKGROUND

Apparatuses for controlling rotational movement of vehicle turrets continue to evolve. Armored vehicles, for example, may include a rotatable turret and a weapon mounted to the turret for use in military operations. To assist the turret operator in rotating the turret, a controlled drive system may be installed in the armored vehicle. The drive system may consist of a motor that drives rotation of the turret and a controller that instructs the motor. For example, the controller may instruct the motor to rotate the turret clockwise or counterclockwise depending on input from the turret operator.

Known controllers for vehicle turrets may be adapted to receive input from a variety of input device types. For example, a manual joystick having a magnetic base may be secured to the turret or vehicle to control rotation of the turret. Alternatively, a weapon-mounted input device may allow an operator to control rotation of the turret without removing his hands from the weapon. Each type of input device may provide a particular set of advantages. However, known controllers for vehicle turrets may be designed such that only one input device can be connected to the controller. As a result, operators are limited to choosing one type of input device.

Therefore, a need exists for an apparatus for controlling rotational movement of a vehicle turret in response to input signals generated by multiple input devices.

SUMMARY

An apparatus for controlling rotational movement of a turret of a vehicle is provided. The apparatus includes a first communication port that is adapted to receive input signals from a first input device for controlling rotation of the turret. A second communication port is adapted to receive input signals from a second input device for controlling rotation of the turret. A controller generates control signals for operational control of the vehicle turret in response to receipt of an input signal from at least one of the first and second input devices.

A method for controlling rotational movement of a turret of a vehicle is also provided. Input signals are received from at least one of a first and second communication port. The first and second communication ports are adapted to respectively receive input signals from a first and a second input device. Control signals for operational control of the turret are generated at a controller in response to receipt of the input signals from at least one of the input devices.

DETAILED DESCRIPTION

Figure 1:
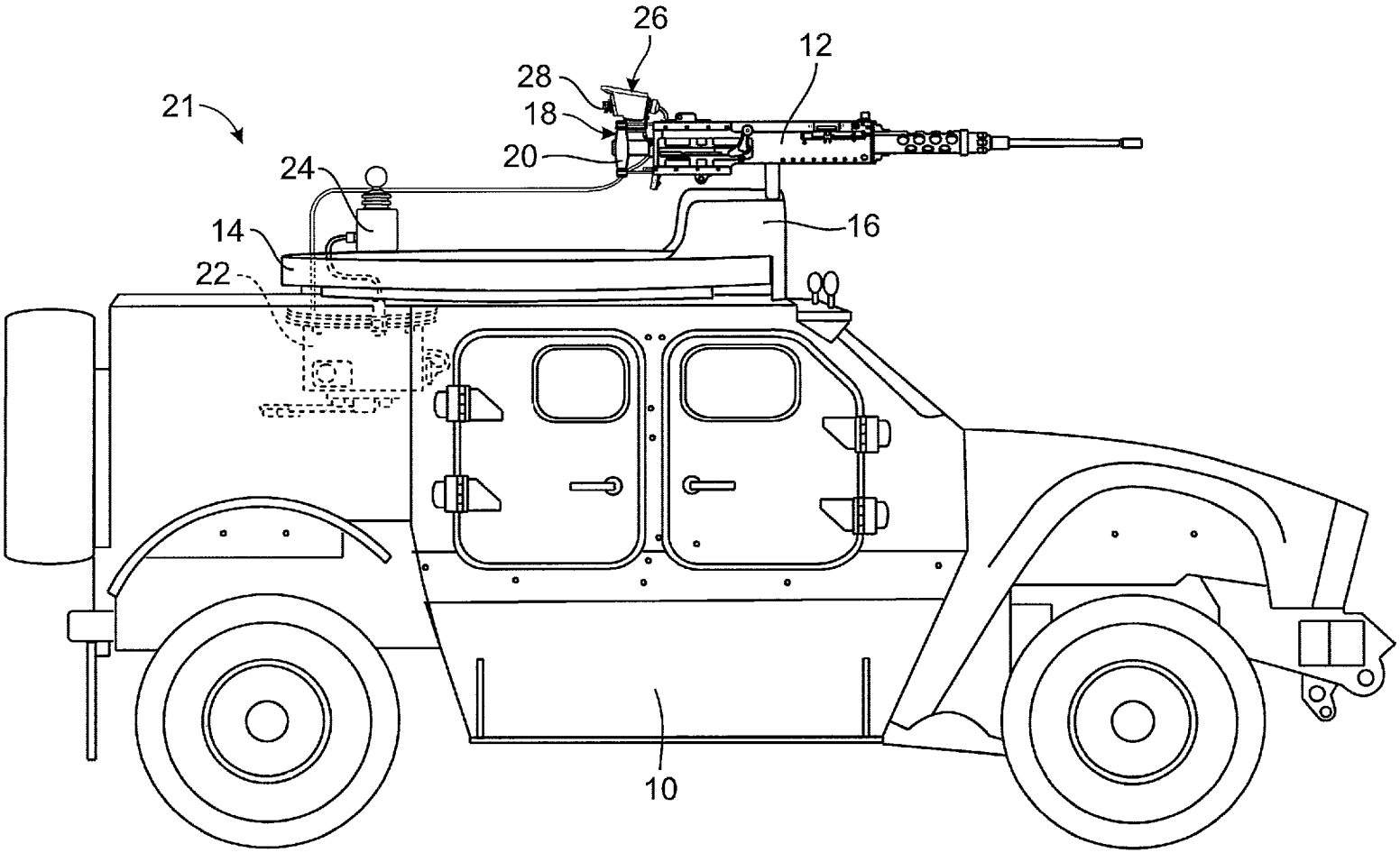
FIG. 1 is a right side view of an armored vehicle having a rotatable turret and a turret controller with a first input device and a second input device coupled to the controller.

An apparatus for controlling rotational movement of a vehicle turret is provided. Referring to FIG. 1, a right profile view of an armored vehicle 10 having a firing device 12 mounted to a rotatable turret 14 is shown. The turret 14 may fully rotate 360° in a clockwise or counterclockwise direction. The turret 14 may include, among other components, shielding 16 to protect an operator during operation of firing device 12. In the example shown, the firing device 12 is a .50-caliber heavy machine gun (United States military designation Browning Machine Gun, Cal .50, M2, HB, Flexible) with a butterfly-style trigger 18. The .50 caliber heavy machine gun 12 is designed to be operated with both hands of an operator. An operator may grasp one of the vertical grips 20 of the butterfly-style trigger with each hand when operating the firing device 12.

As shown in FIG. 1, the vehicle 10 includes an apparatus 21 for controlling the rotational movement of the turret 14. The apparatus 21, in the example shown, includes a controller 22 that controls rotation of the turret 14. The controller 22 may be situated beneath the rotatable turret 14. In the example shown, two input devices 24, 26 are coupled to the controller 22. The input devices 24, 26 enable an operator to rotate the turret 14 in a clockwise (CW) or counterclockwise (CCW) direction. The first input device 24 is a hand-operated joystick shown mounted to the top of the turret 14. The joystick 24 may have a magnetic base for releasable securement to the turret or vehicle. Thus, an operator may position and reposition the joystick on the turret 14 or on or within the armored vehicle 10 as desired. The second input device 26 may be adapted to be releasably secured to the firing device. In the example shown, the second input device is attached to the butterfly-style trigger 18 of the firing device 12. The second input device 26 is a thumb-controlled input device ("thumbstick") that allows an operator to control rotation of the turret 14 without removing his hands from the trigger 18 of the firing device 12. As seen in FIG. 1, an operator may naturally position his hands on the butterfly-style trigger 18, and the actuator 28 of the thumb-controlled input device 26 is positioned where the thumb of the operator naturally rests when operating the firing device 12.

Figure 2:
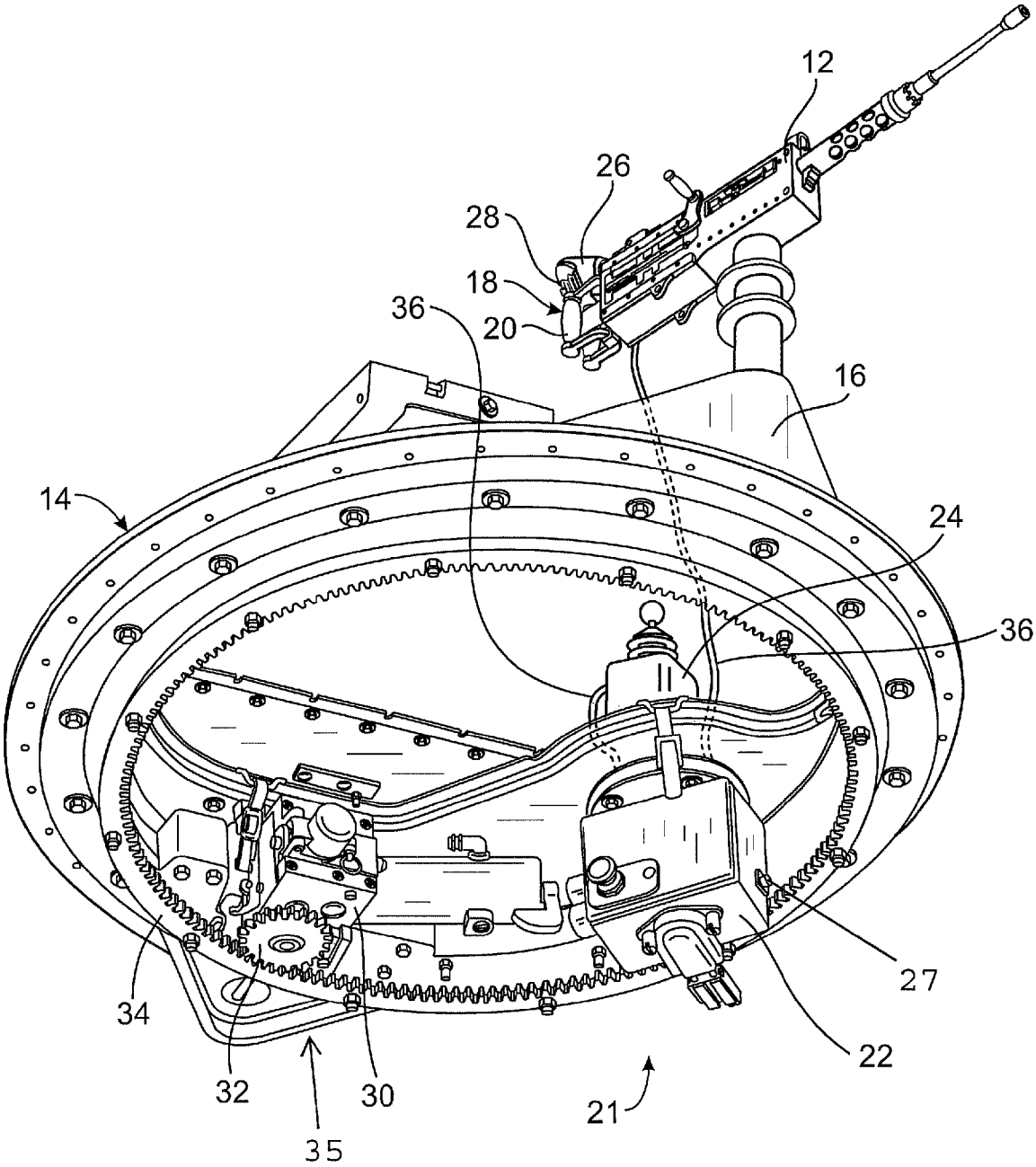
FIG. 2 is a bottom right perspective view of a turret and a controlled turret drive system for an armored vehicle with a first input device and a second input device coupled to a controller of the turret drive system.

Referring now to FIG. 2, a bottom right perspective view of the vehicle turret 14 is shown. As mentioned above, a controller 22 may be attached to the turret 14 for controlling rotation of the turret based on input from an operator. The controller 22 is connected to a motor 30, which is used to drive the rotation of the turret 14. The motor 30 includes a drive gear 32 that meshes with a ring gear 34 mounted to the turret 14. Accordingly, as the motor 30 spins the drive gear 34, the drive gear transmits the torque to the ring gear 34, which causes the turret 14 to rotate in a CW or CCW direction. The motor 30, drive gear 32, and ring gear 34 may be collectively referred to as a turret drive system 35. As seen in FIG. 2, two input devices 24, 26 are attached to the top of the controller 22—a joystick 24 positioned on top of the turret 14 and a thumb-controlled input device 26 attached to the butterfly-style trigger 18 of the firing device 12 mounted to the turret. Each input device 24, 26 is attached to a respective electrical port (FIG. 3) on top of the controller 22 via an electrical cable 36. Other means of coupling the input devices to the controller, such as, for example, a wireless coupling, may be selectively employed.

Figure 3:
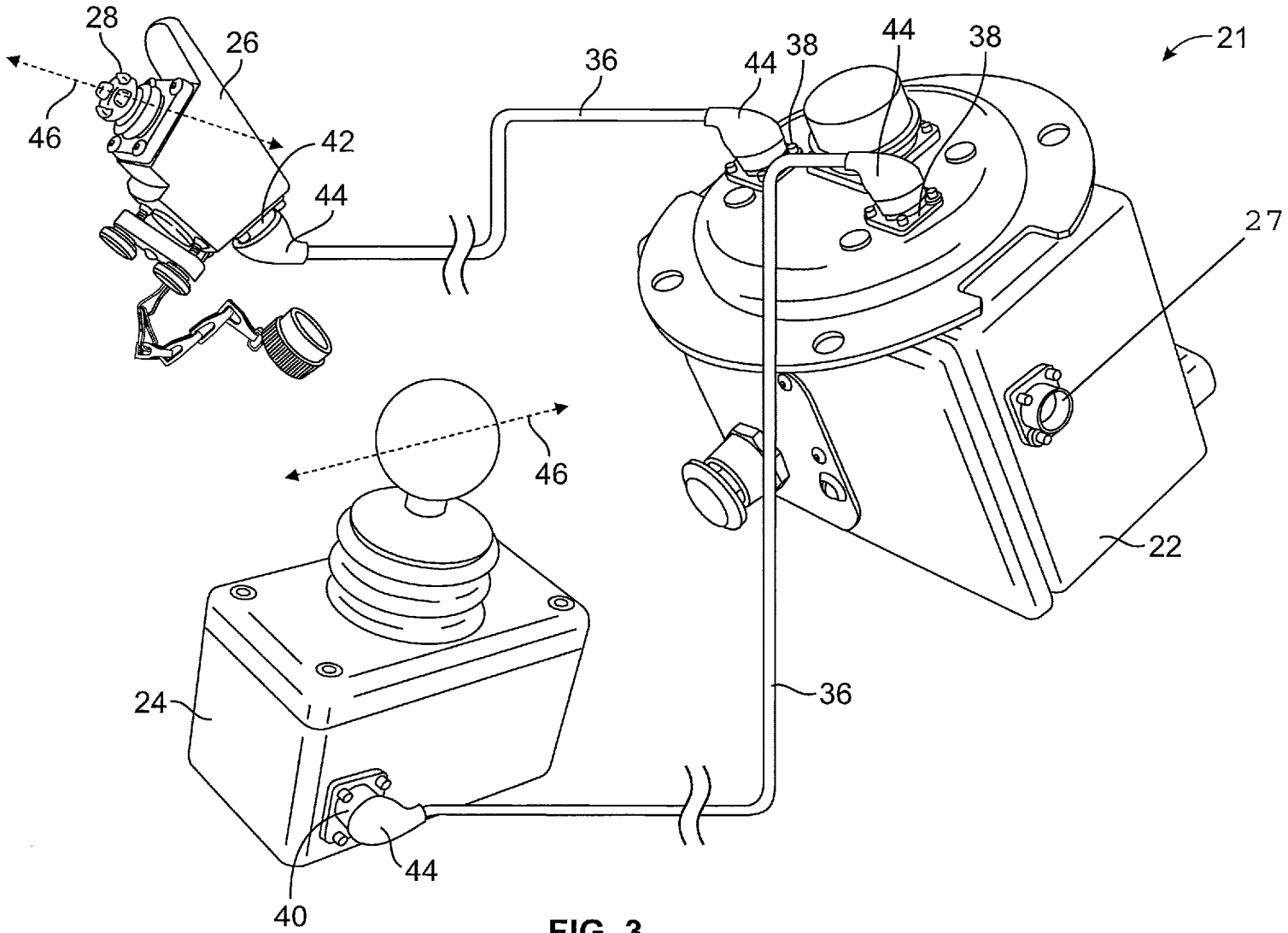
FIG. 3 is a perspective view of a first input device and a second input device coupled to a controller for a vehicle turret.

Referring now to FIG. 3, an example apparatus 21 is shown. The apparatus 21, in the example shown, includes a controller 22. Two input devices 24, 26 are coupled to the controller 22—a joystick 24 and a thumb-controlled input device 26. A suitable joystick, for example, may be available from Control Solutions, LLC of Aurora, Ill. as model designation CS3209, and a suitable thumbstick may similarly be available as model designation CS3210A. The controller 22, in this example, includes two communication ports 38 on the top of the controller. Each input device 24, 26 may also include a respective communication port 40, 42 for transmitting input signals for controlling turret rotation. The communication ports 38 at the controller 22 and the communication ports 40, 42 respectively at the input devices 24, 26 may be any wired or wireless communication interface that can exchange communication signals. In this example, the communication ports 38 at the controller 22 and the communications ports 40, 42 at the input devices 24, 26 are electrical ports. Electrical cables 36 having, for example, 3-pin (or 4-pin) circular bayonet-type connectors 44 may respectively couple the electrical ports 40, 42 of the input devices 24, 26 to an electrical port 38 of the controller 22 as shown by way of example in FIG. 3. Additional or alternative types of wired or wireless couplings between the input devices and the controller may be selectively employed. For example, other wired couplings may include Universal Serial Bus (USB) ports, Ethernet ports, or controller area network (CAN) busses. In an alternative configuration, for example, the communication ports 38 at the controller 22 and the communication ports 40, 42 at the input devices 24, 26 may be wireless transceivers for wireless communication between the controller and the input devices.

The controller 22, in this example, includes software and hardware components (not shown) to generate control signals in response to receipt of the input signals. The controller 22 may transmit the control signals to the turret drive system 35 for controlling the rotation of a vehicle turret 14. For example, the controller 22 may be programmed with logic that interprets input signals from various input devices 24, 26 and is used to generate control signals for the turret drive system 35. The logic may be executed by a processing device (not shown), such as a microprocessor capable of executing instructions or code. The also includes a memory (not shown), which may be any form of data storage mechanism accessible by the processing device or any combination of such forms, such as, a magnetic media, an optical disk, a volatile random access memory (RAM), a flash memory, or a non-volatile electrically erasable programmable read-only memory (EEPROM). Moreover, the controller 22 may include various input/output ports and circuitry (not shown) to monitor readings from various sensors coupled to the controller. Alternative arrangements, such as employment of programmable logic controllers (PLCs) or other control devices may selectively be employed for providing instructions to control rotation of the vehicle turret 14.

Each input device 24, 26 may be deflected to the left or to the right as shown by the arrows 46 in FIG. 3. An operator may use his hand to deflect the joystick 24 to the left or to the right, and an operator may use his thumb to deflect the actuator 28 of the thumb-controlled input device 26 to the left and to the right. Input devices 24, 26 may be described by their magnitude of actuation, such as, for example, their percentage of deflection from a neutral position. As shown in FIG. 3, both the joystick 24 and the thumb-controlled input device 26 are in a neutral position; the input devices are not deflected in either direction and can be described as having 0% deflection. When the input devices 24, 26 are fully deflected to the left or right, the input devices can be described as having 100% deflection left or 100% deflection right respectively. Similarly, when the input devices 24, 26 are between the neutral position (0% deflection) and the fully deflected position (100%) deflected, the input devices may be described by the direction and percentage of deflection, such as, for example, 50% deflection to the left.

The input devices 24, 26 transmit input signals to the controller 22 corresponding to an actuated position of the input device. The input signals may be, for example, a variable analog voltage signal. The magnitude of the voltage of the input signal may correspond to the magnitude of actuation of the input device, which is the percentage of deflection in this example. A signal processor (not shown) at the controller 22 may convert the input signals to control signals. The control signals, in this example, are based on the voltage magnitude of the input signals received. Thus, the control signals can also be said to correspond to an actuated position of the input devices 24, 26. The control signals, in this example, correspond to the direction and the rotational speed of the turret 14. The controller 22 transmits the control signals to the motor 30 (FIG. 2) in order to control rotation the turret 14 (FIGS. 1-2).

In this example, the direction and the rotational speed of the turret 14, corresponds to the voltage magnitude of input signals received from an input device 24, 26. The voltage signals received from the input devices 24, 26 may be between a predetermined voltage range such as, for example, approximately 0 volts (V) and 5 volts. Throttle settings at the controller 22 may determine the nature of the voltage range. The throttle settings may, in turn, determine how the controller 22 responds to receipt of various voltage signals. As an example, approximately 2.5V may represent the middle of the 0V to 5V voltage range and correspond to a neutral position of an input device 24, 26. In other words, when an input device 24, 26 is in a neutral position, the input device may transmit an input signal of approximately 2.5V. When input devices 24, 26 rest in the neutral position, the motor 30 does not rotate the turret 14. An input signal voltage near the lower end of the voltage range (e.g., below 2.5V) may be used to generate a control signal that corresponds to turret rotation in one direction (e.g., a CCW direction). An input signal voltage near the upper end of the voltage range (e.g., above 2.5V) may be used to generate a control signal that corresponds to turret rotation in another direction (e.g., a CW direction).

The predetermined voltage range may also include a neutral band proximate to the neutral position (2.5V in the example above). The neutral band may be used to ignore certain input signals received at the controller 22, such as signals resulting from shorts in the cables 36. The neutral band may extend both above and below the neutral position of 2.5V—for example, up to 2.7V and down to 2.3V. Thus, in this example, a controller 22 may ignore voltage signals between approximately 2.3V and 2.7V. Accordingly, the controller 22 may instruct the motor 30 to drive the turret 14 in one direction (e.g., CCW) in response to a voltage signal below 2.3V and instruct the motor to drive the turret in another direction (e.g., CW) in response to a voltage signal above 2.7V.

For similar reasons, the voltage range may also include failure bands at the upper end and lower end of the voltage range. Continuing the example voltage range of 0V to 5V used above, the voltage range may include a lower failure band from approximately 0V to approximately 1V as well as a failure band from approximately 4V to approximately 5V. The failure bands are also used to ignore certain input signals (e.g., signals resulting from shorts in the cables 36) at the outer edges of the voltage range. Accordingly, in conjunction with the neutral bands discussed above, the controller 22 may instruct the motor 30 to drive the turret 14 in one direction (e.g., CCW) in response to a voltage signal between around 1V to around 2.3V (a first active band) and drive the turret in another direction (e.g., CW) in response to a voltage signal between around 2.7V and 4V (a second active band).

Moreover, the voltage magnitude of the input signal may also be used to generate a control signal that corresponds to the rotational speed of the turret. As another example, 100% deflection of an input device 24, 26 to the left may correspond to a 1V input signal, which in turn corresponds to CCW rotation of the turret 14 at maximum speed. In contrast, 50% deflection of an input device 24, 26 to the left may correspond to a 1.75V input signal, which corresponds to CCW rotation of the turret 14 at half speed. Similarly, 100% deflection of the input device 24, 26 to the right may result in a 4V input signal and CW rotation of the turret 14 at maximum speed whereas 50% deflection of the input device to the right may result in a 3.25V input signal and CW rotation of the turret at half speed. Other configurations may be selectively employed to transmit input signals that correspond to a direction and rotation speed to the controller 22 from the input devices 24, 26. For example, the controller 22 may include a third communication port 27 that provides access to these voltage settings. An operator may modify the throttle settings using a computing device (not shown) attached to the controller 22 at the communication port 27. In this way, operators may adjust the neutral bands, failure bands, and active bands to desired voltage ranges.

As discussed further below with reference to FIGS. 4A-F, the controller 22, in this example, continuously monitors the signals received from each input device 24, 26. Since each input device 24, 26 may be used simultaneously, the controller 22 is programmed with logic to determine which input device to respond to. Firmware (not shown) at the controller 22 includes the logic that determines the appropriate response when the controller receives the input signals. Because two input devices 24, 26 are used, the firmware, in this example, is configured to determine the appropriate response when each input device is actuated simultaneously. Various approaches may be selectively employed to determine how the controller should respond when the input devices 24, 26 are actuated simultaneously.

In the following examples, the response to simultaneous actuation of the input devices 24, 26 depends on the direction of deflection and the magnitude of deflection of each input device. In a first example approach, if the input devices 24, 26 are actuated simultaneously in the same direction, the controller 22 generates a control signal to rotate the turret 14 in the direction of and at a rotation speed corresponding to the input signal from the input device having the greater magnitude of deflection. If the input devices 24, 26 are actuated in different directions, the controller 22, in this first example approach, reduces the rotation speed corresponding to the input signal from the input device having the greater magnitude of deflection by the rotation speed corresponding to the input signal from the input device having the smaller magnitude of deflection. Accordingly, the controller 22 generates a control signal to rotate the turret 14 in the direction corresponding to the input signal from the input device having the greater magnitude of deflection at a rotation speed equal to the difference in rotation speeds between the input devices.

In a second example approach, if the input devices 24, 26 are actuated simultaneously in different directions, the controller 22 does not generate a control signal to rotate the turret 14, and no turret rotation occurs. In a third example approach, the controller 22 may designate one of the input devices 24, 26 as having priority (the priority input device) over the other input device (the non-priority input device). In this third example approach, the controller responds to input signals from the non-priority input device if the priority input device is in a neutral position (e.g., not in an actuated position) and does not respond to input signals from the non-priority input device when the priority input device is not in a neutral position (e.g., in an actuated position). In a fourth example approach, the controller 22 may shift priority between the input devices 24, 26 based on which input device was last actuated. For example, if a turret operator last used the thumbstick 26 to rotate the turret, then the thumbstick has priority over the joystick 24, and the controller 22 will not respond to actuation of the joystick unless the thumbstick is in neutral. Once the turret operator uses the joystick to rotate the turret in this example, however, the controller 22 shifts the priority to the joystick.

Further, an operator may also use the communication port 27 at the controller 22 to change the behavior of the controller using a programming device. The operator may use the programming device to configure the controller 22 to apply any of the example approaches discussed above or other alternative approaches for determining the appropriate response when input signal are received at the controller. It will also be understood that a third input device (not shown) may be coupled to the controller 22 at the communication port 27 for, e.g., digital turret control.

As described by way of example below, the controller 22 determines the appropriate response according to the first example approach discussed above. For example, when each input device 24, 26 is deflected in the same direction, the controller 22 may ignore the input device having the smaller amount of deflection (i.e., the smaller magnitude of actuation) and respond to the input device having a greater amount of deflection (i.e., the greater magnitude of actuation). Accordingly, the controller 22 may generate control signals that correspond to the direction and rotation speed corresponding to the input signal from the input device having the greater amount of deflection.

As another example, when the input devices 24, 26 are deflected in different directions, the controller 22 may reduce the rotation speed corresponding to the input signal from the input device having the greater amount of deflection by the rotation speed corresponding to the input signal from the input device having the smaller amount of deflection in order to obtain a reduced rotation speed. Accordingly, the controller 22 may generate control signals corresponding to the reduced rotation speed and the direction of the input device having the greater amount of deflection.

If the input devices 24, 26 are each deflected in different directions having an equal amount of deflection, the controller 22 may ignore both input devices resulting in no motor movement and thus no turret rotation. If one input device is actuated and the other input device is not actuated, the controller 22 will generate control signals corresponding to the direction and magnitude of actuation of the actuated input device. These example approaches and scenarios are illustratively shown in FIGS. 4A-F and discussed further below. Those skilled in the art will recognize that additional or alternative approaches to handling simultaneous input from both input devices 24, 26 may be selectively employed as discussed above.

As discussed above, the input devices 24, 26, in this example, transmit an analog voltage signal to the controller 22. The controller 22, in turn, processes the voltage signal to determine the appropriate rotation speed and direction of rotation for the turret 14. The controller 22, in this example, determines whether the voltage of a received input signal falls into the neutral band, active band, or failure band. If the voltage of the input signal falls into a neutral band or a failure band, then the controller 22, in this example, does not process the input signal and does not generate control signals to rotate the turret. If the voltage of the input signal falls into the active band, however, the controller 22, in this example, converts the analog signal to a digital signal using, e.g., an analog-digital converter (not shown). The controller 22, in this example, then processes the digital signal using, e.g., a digital signal processor (not shown) to determine the direction and speed of rotation based on the digital signal. The controller 22 may process the digital signal to obtain a direction value and a speed value. The direction value may be, for instance, a 1-bit value that corresponds to a direction of rotation (e.g., CW=1 and CCW=0). Similarly, the speed value may be, for example, an 8-bit value (i.e., 0-255) that corresponds to the magnitude of deflection at an input device.

Where the controller 22 receives input signals from each input device 24, 26 simultaneously, the controller, in this example, compares the direction bits associated with each input device. If the direction bits are the same (i.e., the input devices are actuated in the same direction), the controller 22, in this example, uses the larger speed value when generating the control signals for turret rotation. If the direction bits differ, however, the controller 22, in this example, subtracts the smaller speed value from the larger speed value to obtain a reduced speed value. The controller 22 then uses the reduced speed value when generating the control signals for turret rotation. It will be understood, however, that the controller 22 may be configured to selectively process the input signals in an alternative fashion such as, for example, according to the example approaches discussed above.

FIGS. 4A-F may be further understood with reference to Table 1 provided below. As mentioned above, the controller 22 for the vehicle turret continuously monitors input from the input devices 24, 26. As shown in Table 1 below and further in FIGS. 4A-F, where each input device 24, 26 is deflected in the same direction, the controller 22 responds to the input device having the higher amount of deflection; where the input devices are deflected in opposite directions, the controller subtracts the smaller amount deflection from the larger amount of deflection. Deflection of an input device 24, 26 to the right, in this example, may correspond to clockwise rotation of the turret, and deflection of an input device 24, 26 to the left may correspond to counterclockwise rotation.

TABLE 1

INPUT DEVICE SCENARIOS AND CORRESPONDING MOTOR OUTPUT

| Input Device 1 | Input Device 2 | Motor Output |
|---|---|---|
| LEFT 100% | 0% | CCW 100% |
| LEFT 100% | LEFT 50% | CCW 100% |
| LEFT 75% | LEFT 50% | CCW 75% |
| LEFT 100% | RIGHT 100% | no motor movement |
| LEFT 50% | RIGHT 50% | no motor movement |
| LEFT 75% | RIGHT 50% | CCW 25% |
| LEFT 50% | RIGHT 75% | CW 25% |

Figure 4A:
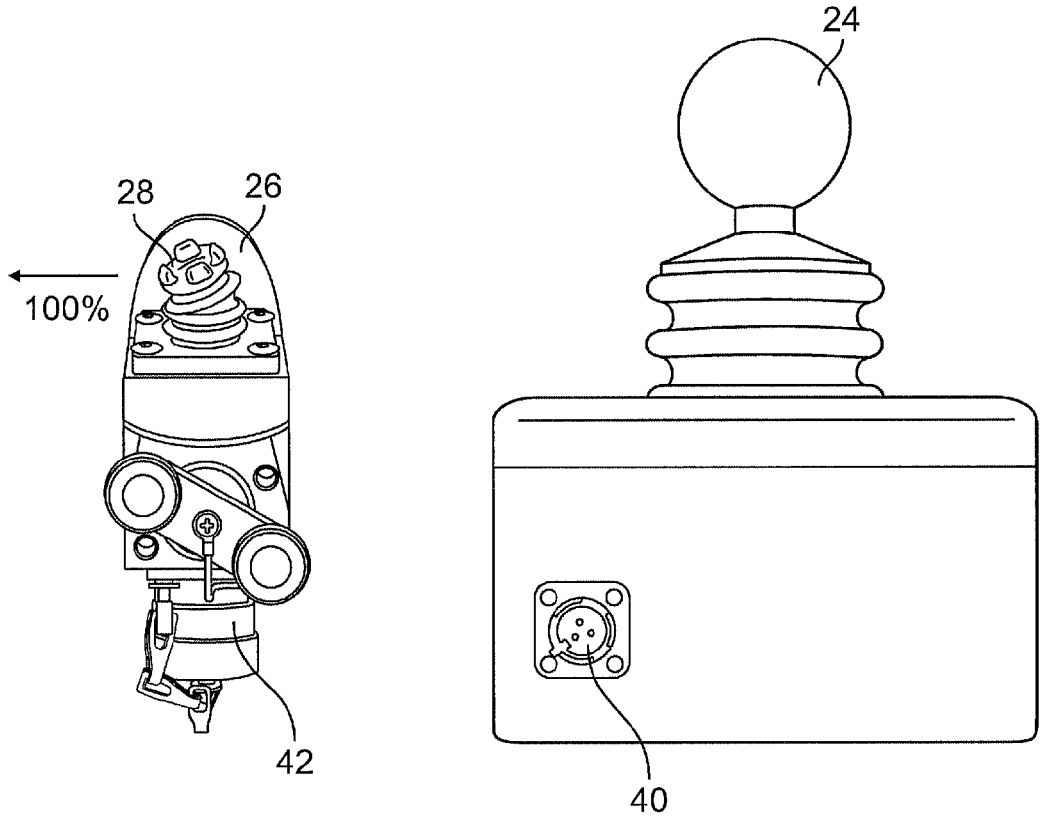
FIG. 4A is a front view of a first input device and a second input device in a first mode of operation.

With reference to FIG. 4A, a first mode of operation is shown. In this first mode of operation, only the thumb-controlled input device 26 is actuated; the joystick 24 is not actuated. As seen in FIG. 4A, the thumb-controlled input device 26 is deflected 100% to the left, and the joystick 24 remains at the center having 0% deflection. In the example shown, 100% deflection to the left corresponds to 100% CCW motor output resulting in 100% CCW rotational speed of the turret, i.e., CCW rotation of the turret at maximum RPM.

Figure 4B:
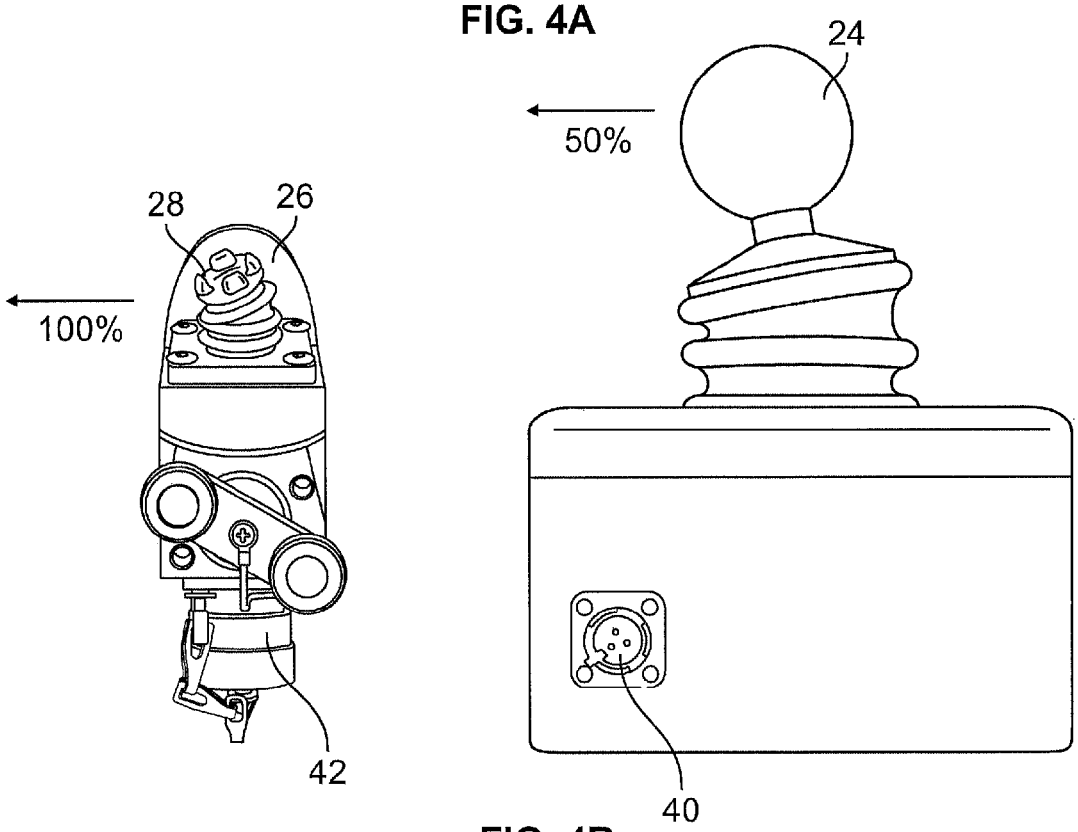
FIG. 4B is a front view of a first input device and a second input device in a second mode of operation.

Referring now to FIG. 4B, a second mode of operation is shown. In this second mode of operation, both the thumb-controlled input device and the joystick are deflected to the left. However, the thumb-controlled input device is deflected 100% to the left whereas the joystick is deflected 50% to the left. As mentioned above, when both input devices are deflected in the same direction but at a different amount of deflection, the controller will respond to the input device having the larger amount of deflection. In FIG. 4B, the thumb-controlled input device has a larger amount of deflection; thus, the controller will respond to the thumb-controller. At 100% deflection to the left, the resulting motor output, in the example shown, is 100% CCW rotational speed of the turret.

Figure 4C:
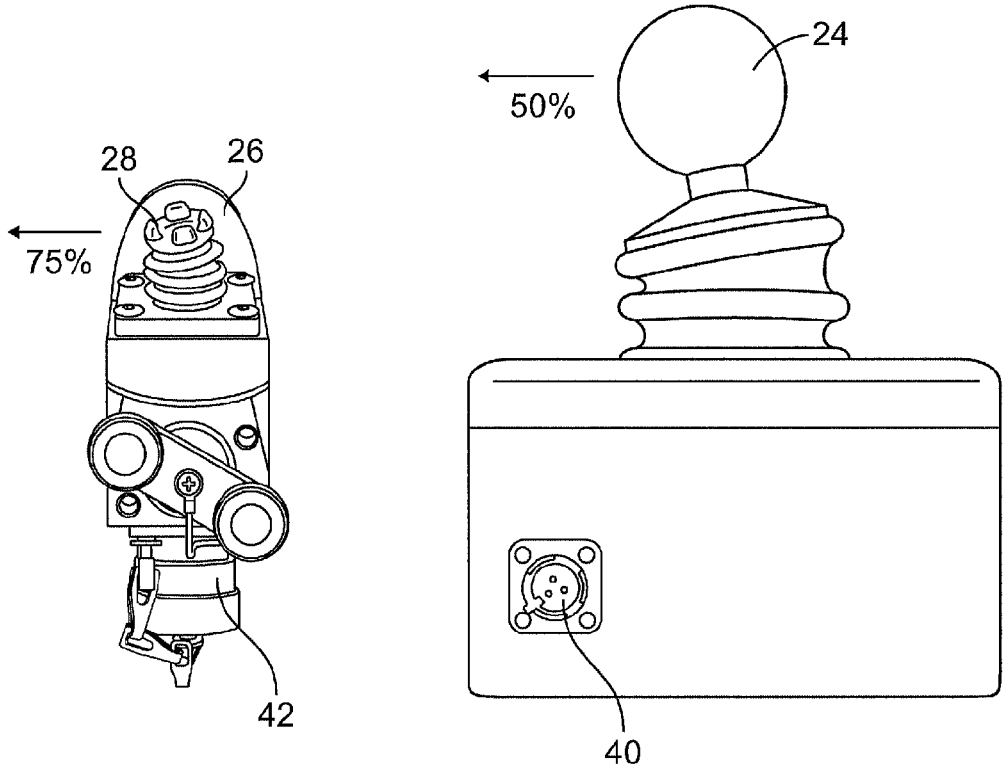
FIG. 4C is a front view of a first input device and a second input device in a third mode of operation.

Turning to FIG. 4C now, a third mode of operation is shown. Like FIG. 4B, both input devices are deflected to the left. In FIG. 4C, however, the thumb-controlled input device is 75% deflected to the left and the joystick is 50% deflected to the left. However, because the thumb-controlled input device has a greater amount of deflection (75%>50%), the controller will still respond to the thumb-controlled input device. The motor output, in the example shown, is 75% CCW rotational speed in response to the 75% left deflection of the thumb-controlled input device.

Figure 4D:
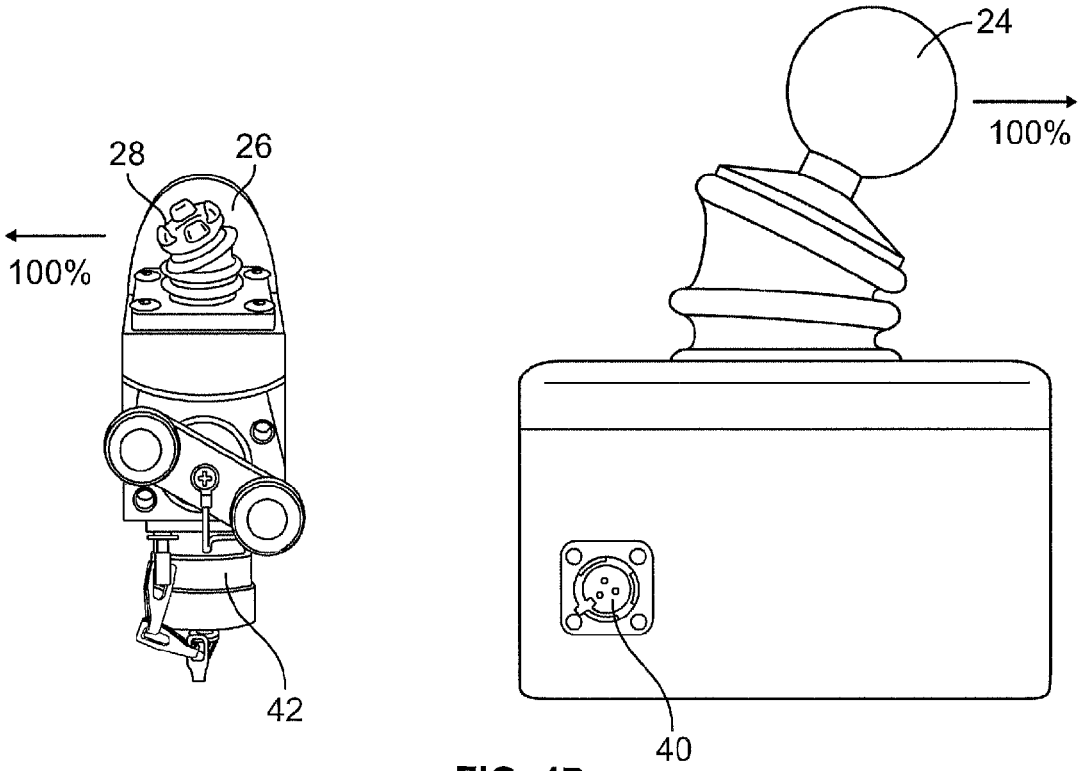
FIG. 4D is a front view of a first input device and a second input device in a fourth mode of operation.

In FIG. 4D, a fourth mode of operation is shown. As with FIGS. 4B-C, both input devices are deflected. However, in FIG. 4D, the input devices are deflected in opposite directions and have the same amount of deflection. In FIG. 4D, the thumb-controlled input device is deflected 100% to the left whereas the joystick is deflected 100% to the right. In this example mode of operation, the input from each device is cancelled out. As mentioned above, when the input devices are deflected in opposite directions, the larger amount of deflection is subtracted from the smaller amount of deflection. In FIG. 4D, where the amounts of deflection are equal, the result is 0% and no motor movement occurs.

Figure 4E:
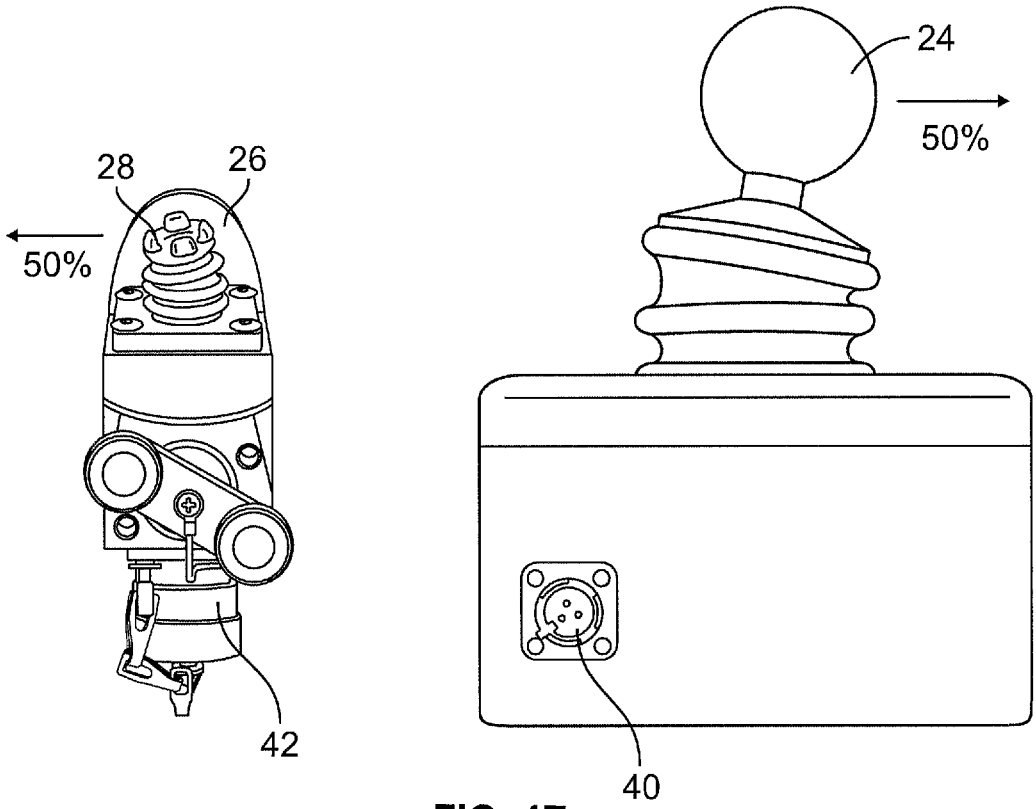
FIG. 4E is a front view of a first input device and a second input device in a fifth mode of operation.

This feature is further illustrated in FIG. 4E where the input devices are deflected in opposite directions and have equal amounts of deflection. In FIG. 4E, the thumb-controlled input device is deflected 50% to the left, and the joystick is deflected 50% to the right. Like the examples seen in FIG. 4D, the input from each device is cancelled out resulting in no motor movement.

Figure 4F:
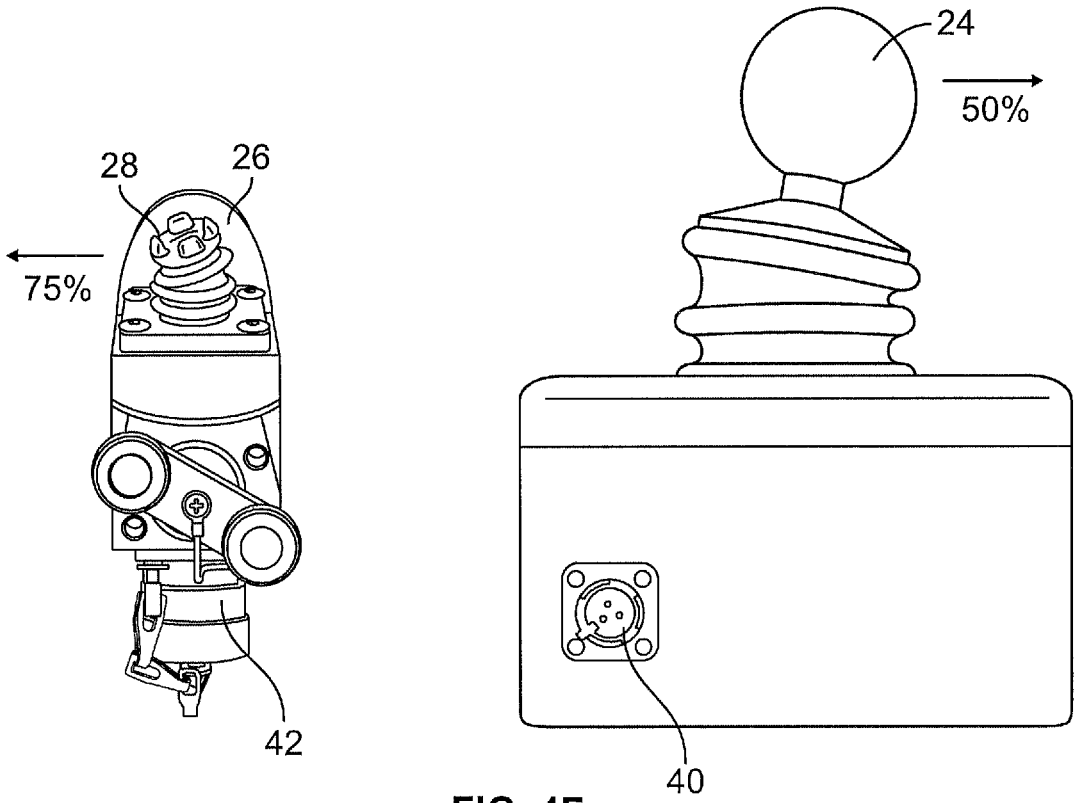
FIG. 4F is a front view of a first input device and a second input device in a sixth mode of operation.

Referring now to FIG. 4F, another mode of operation is shown. In FIG. 4F, the thumb-controlled input device is deflected 75% to the left, and the joystick is deflected 50% to the right. Subtracting the larger amount of deflection at the thumb-controlled input device (75%) from the smaller amount of deflection at the joystick (50%) results in 25% CCW motor output, which further results in 25% CCW rotational speed of the turret. This scenario is alternatively shown in the last row of Table 1 above where input device 1 is deflected 50% to the left and input device 2 is deflected 75% to the right. Accordingly, the 50% left deflection is subtracted from the 75% right deflection resulting in 25% CW motor output and thus 25% CW rotational speed of the turret.

The various modes of operation described above include the basic scenarios for the position of a thumb-controlled input device and joystick. Those skilled in the art will recognize that other modes of operation are possible. For example, if a thumb-controlled input device is deflected 30% to the LEFT and a joystick is deflected 90% to the right, 60% CW motor output and turret rotation will result in accordance with the description provided above. Further, those skilled in the art will appreciate that the controller may receive control signals from two input devices of the same type (e.g., two joysticks, two thumb-controlled input devices, etc.) or from alternative types of input devices.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that a certain of the details described herein can be varied considerably without departing from the basic principles of the invention.

What is claimed is:

1. An apparatus for controlling rotational movement of a turret of a vehicle comprising:

a first communication port that receives input signals from a first input device for controlling rotation of the turret;

a second communication port that receives input signals from a second input device for controlling rotation of the turret;

a controller, the controller generates a control signal for operational control of the turret in response to receipt of an input signal from at least one of the first and second input devices.

2. The apparatus of claim 1 wherein the control signal corresponds to an actuated position of at least one of the first input device and the second input device.

3. The apparatus of claim 2 wherein the control signal corresponds to a direction of rotation of the turret.

4. The apparatus of claim 2 wherein the control signal corresponds to a rotational speed of the turret.

5. The apparatus of claim 2 wherein the controller determines whether the first input device and the second input device are simultaneously actuated.

6. The apparatus of claim 5 wherein upon the controller determining that the first input device and the second input device are simultaneously actuated in the same direction and upon determining which of the first input device or the second input device has a greater magnitude of actuation:

the controller generates a control signal corresponding to the direction and magnitude of actuation of the input device having a greater magnitude of actuation.

7. The apparatus of claim 5 wherein:

the controller receives a first input signal from the first input device and a second input signal from the second input device;

the controller determines a first rotational speed that corresponds to the first input signal and a second rotational speed that corresponds to the second input signal;

the controller determines the first input device and the second input device are simultaneously actuated in different directions at different magnitudes of actuation;

the controller reduces the rotational speed corresponding to the input signal from the input device having the greater magnitude of actuation by the rotational speed corresponding to the input signal from the input device having the smaller magnitude of actuation to obtain a reduced rotational speed; and the controller generates a control signal corresponding to the reduced rotational speed and the direction of actuation of the input device having the greater magnitude of actuation.

8. The apparatus of claim 2 wherein:

the controller determines that the first input device is actuated and the second input device is not actuated; and the controller generates a control signal corresponding to the direction and magnitude of actuation of the first input device.

9. The apparatus of claim 1 wherein the input signals received at the first and second communication ports comprise variable voltage signals and the controller continuously monitors the variable voltage signals.

10. The apparatus of claim 9 wherein the controller generates a control signal in response to receipt of an input signal within a predetermined voltage range.

11. The apparatus of claim 10 wherein the controller generates a control signal corresponding to a rotational speed of the turret based on the magnitude of a variable voltage signal received at the controller.

12. The apparatus of claim 10 wherein the controller generates a control signal corresponding to a first direction of rotation of the turret in response to receipt of a variable voltage signal proximate to a first end of the predetermined voltage range and generates a control signal corresponding to a second direction of rotation different from the first direction of rotation in response to receipt of a variable voltage signal proximate to a second end of the predetermined voltage range different from the first end.

13. The apparatus of claim 1 wherein the controller ignores input signals within a failure band proximate to at least one of a first end of a predetermined voltage range and a second end of the predetermined voltage range different from the first end.

14. The apparatus of claim 1 wherein the controller ignores input signals within a neutral band proximate a middle of a predetermined voltage range.

15. The apparatus of claim 1 wherein the first input device is adapted for releasable securement to the turret or vehicle and the second input device is adapted for releasable securement to a firing device mounted to the turret.

16. The apparatus of claim 15 wherein the first input device is a joystick and the second input device is a thumbstick.

17. A method for controlling rotational movement of a turret of a vehicle comprising:

receiving input signals from at least one of a first communication port and a second communications port, the first and second communication ports respectively receiving input signals from a first input device and a second input device; and generating, at a controller, a control signal for operational control of the turret in response to receipt of the input signals from at least one of the first and second input devices.

18. The method of claim 17 wherein the control signal corresponds to an actuated position of at least one of the first input device and the second input device.

19. The method of claim 18 wherein the control signal corresponds to a direction of rotation of the turret.

20. The method of claim 18 wherein the control signal corresponds to a rotation speed of the turret.

21. The method of claim 18 further comprising determining whether the first input device and the second input device are simultaneously actuated.

22. The method of claim 21 further comprising:

determining that the first input device and the second input device are simultaneously actuated in the same direction;

determining which of the first input device and the second input device has a greater magnitude of actuation; and generating, at the controller, a control signal corresponding to the direction and magnitude of actuation of the input device having a greater magnitude of actuation.

23. The method of claim 21 further comprising:

receiving a first input signal from a the first input device and a second input signal from the second input device;

determining a first rotation speed corresponding to the first input signal and a second rotation speed corresponding to the second input signal;

determining that the first input device and the second input device are simultaneously actuated in different directions at different magnitudes of actuation;

reducing the rotation speed corresponding to the input signal for the input device having the greater magnitude of actuation by the rotation speed corresponding to the input signal for the input device having the smaller magnitude of actuation to obtain a reduced rotation speed; and generating, at the controller, a control signal corresponding to the reduced rotation speed and the direction of the input device having the greater magnitude of actuation.

24. The method of claim 18 further comprising:

determining that the first input device is actuated and that the second input device is not actuated; and generating, at the controller, a control signal corresponding to the direction and magnitude of actuation of the first input device.

25. The method of claim 17 wherein the input signals received at the first and second communication ports comprise variable voltage signals and further comprising continuously monitoring the variable voltage signals.

26. The method of claim 25 further comprising generating, at the controller, a control signal in response to receipt of an input signal within a predetermined voltage range.

27. The method of claim 26 further comprising generating a control signal corresponding to a rotational speed of the turret based on the magnitude of a variable voltage signal received at the controller.

28. The method of claim 26 further comprising:

generating, at the controller, a control signal corresponding to a first direction of rotation of the turret in response to receipt of a variable voltage signal proximate to a first end of the predetermined voltage range; and generating, at the controller, a control signal corresponding to a second direction of rotation of the turret different from the first direction of rotation in response to receipt of a variable voltage signal proximate to a second end of the predetermined voltage range different from the first end.

29. The method of claim 17 further comprising ignoring input signals within a failure band proximate to at least one of a first end of a predetermined voltage range and a second end of the predetermined voltage range different from the first end.

30. The method of claim 17 further comprising ignoring input signals within a neutral band proximate a middle of a predetermined voltage range.

31. The method of claim 17 wherein the first input device is adapted for releasable securement to the turret or vehicle and the second input device is releasably secured to a firing device mounted to the turret.

32. The method of claim 31 wherein the first input device is a joystick and the second input device is a thumbstick.

* * * * *